US011492814B1

(12) United States Patent
Nowell

(10) Patent No.: US 11,492,814 B1
(45) Date of Patent: Nov. 8, 2022

(54) FLOOR PREPARATION TOOL

(71) Applicant: Philip Nowell, Hollywood, FL (US)

(72) Inventor: Philip Nowell, Hollywood, FL (US)

( * ) Notice: Subject to any disclaimer, the term of this patent is extended or adjusted under 35 U.S.C. 154(b) by 0 days.

(21) Appl. No.: 17/574,637

(22) Filed: Jan. 13, 2022

(51) Int. Cl.
*B24B 7/18* (2006.01)
*E04G 23/00* (2006.01)

(52) U.S. Cl.
CPC ..... *E04G 23/006* (2013.01); *B24B 7/18* (2013.01)

(58) Field of Classification Search
CPC ..... E04G 23/006; B24B 7/18
See application file for complete search history.

(56) References Cited

U.S. PATENT DOCUMENTS 2,769,626 A * 11/1956 Anthony ..... E01C 23/0885 15/93.1
4,385,412 A * 5/1983 Neufeldt ..... A47L 13/08 15/93.1
5,683,143 A * 11/1997 Peterson ..... B28D 1/188 451/353
6,021,771 A * 2/2000 Swan ..... B28D 1/181 125/5
7,104,739 B2 * 9/2006 Lagler ..... B27G 13/10 407/41

* cited by examiner

*Primary Examiner* — Janine M Kreck
(74) *Attorney, Agent, or Firm* — Christopher J. Vandam, P.A.; Chris Van Dam

(57) ABSTRACT

A tool that attaches to an underside of a rotating floor stripper machine that includes a plurality of bracket assemblies that each contain a blade assembly. The blades are equally spaced around segments of the underside of the plate. The cutting angle of each blade is selected to have a specific angle of incidence and each blade is configured askew from the radial line of the plate. Each blade assembly further includes a suspension to absorb imbalance caused by interaction with irregular surfaces during operation to greatly smooth out the machine and improve control. Alternate forms of cutting blades are provided to remove different materials and cause smoother or coarser cuts.

4 Claims, 5 Drawing Sheets

FLOOR PREPARATION TOOL

CROSS-REFERENCES TO RELATED APPLICATIONS

None.

STATEMENT REGARDING FEDERAL SPONSORED RESEARCH OR DEVELOPMENT

None.

NAMES OF PARTIES TO A JOINT RESEARCH AGREEMENT

None.

REFERENCE TO A "SEQUENCE LISTING", A TABLE, OR A COMPUTER PROGRAM LISTING APPENDIX SUBMITTED ON COMPACT DISC AND INCORPORATION-BY-REFERENCE OF THE MATERIAL ON THE COMPACT DISCLOSURE

None.

STATEMENT REGARDING PRIOR DISCLOSURES BY AN INVENTOR OR JOINT INVENTOR

None.

BACKGROUND OF THE INVENTION

1. Field of the Invention

The present invention relates to construction power tools, and more particularly, to an improved device for preparing a floor surface.

2. Description of Related Art Including Information Disclosed Under 37 CFR 1.97 and 37 CFR 1.98

Several designs for floor preparation tools have been designed in the past. None of them, however, include a series of replaceable tools oriented askew to the rotational radius where each tool has an independent suspension and is individually replaceable.

Applicant believes that the closest references correspond to commercially available floor sanders and grinders that have been in use for decades. However, it differs from the present invention because the present invention includes a plurality of individual tools that each have an independent suspension to smooth and make safer the operation of the device and where each of the tools is oriented skewed to the radius of the arc of rotation to cause a slicing action of the tool against a floor surface.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

Brief Summary of the Invention

It is one of the main objects of the present invention to provide a floor preparation tool that is both highly stable and easy to use.

It is another object of this invention to provide a floor preparation tool with independently replaceable consumable elements.

It is yet another object of the present invention to provide a floor preparation tool with easy to replace blade assemblies to adapt the machine to differing floor surfaces and materials to be removed from those floor surfaces.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
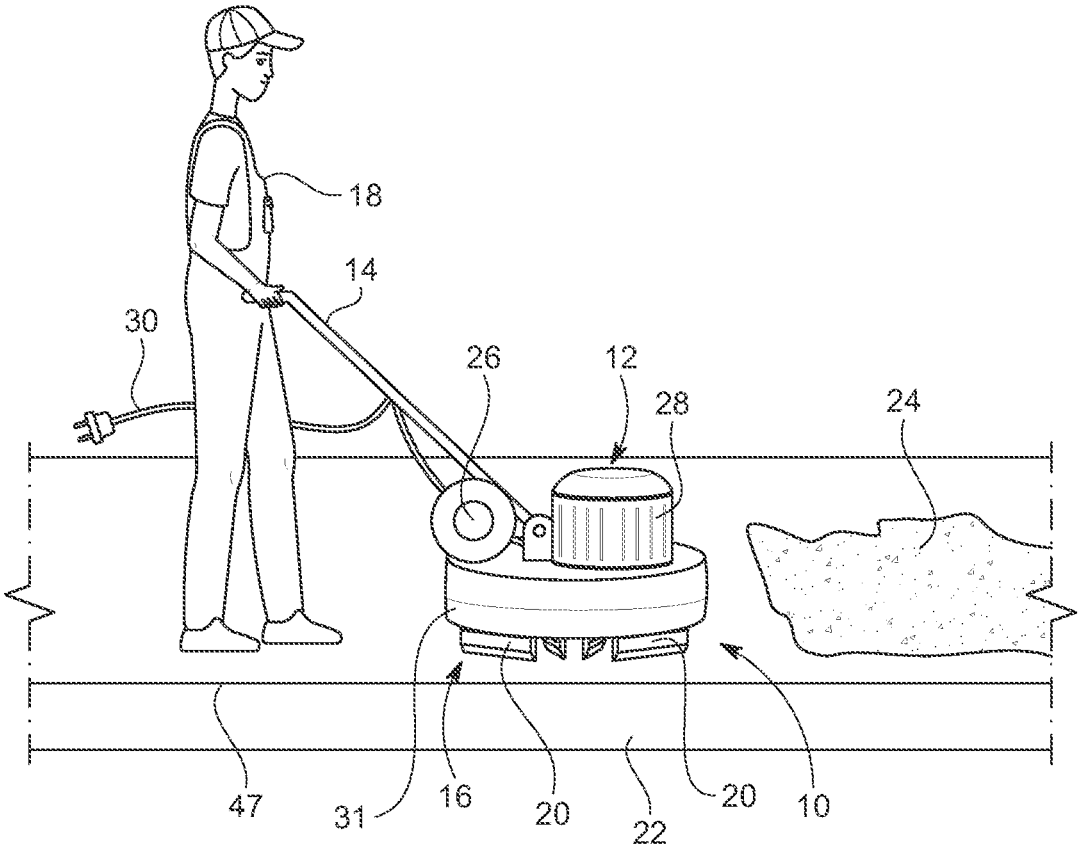
FIG. 1 shows a perspective view of an operator using a floor stripper machine.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the floor preparation tool, the tool, the floor stripper, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the context and related drawings.

Referring now to the drawings, where the present invention is generally referred to with numeral 10, it can be observed that it basically includes a floor preparation machine 12, a handle 14, a blade assembly 16, an operator 18, a blade 20, a floor 22, a material 24, a wheel 26, a motor 28, a court 30, a plate 31, a bracket assembly 32, a suspension 33, a guide slot 34, a guide slot 35, a base 36, a pen 37, a key 38, a flange 39, a tab 40, a blade 41, a frame 42, a flange 43, a support 44, a fastener 45, a flange 46, a surface 47, a frame 48, a tool 49, tines 50, a blade assembly 51, a radius R1, an axis X1, an axis X2, an axis X3, an angle A1 and an angle A2.

Generally, a floor stripper machine is used to prepare a surface 47 of a floor 22 in anticipation of applying a new floor covering onto the surface 47. Prior to applying a new floor covering, the surface 47 must be cleared of any residual material 24 from a previous floor covering. This is done to avoid any unevenness, floor irregularities and provide a suitable bonding surface for the new floor covering by preventing an anticipated floor covering from interaction with previous adhesives or other contaminants.

For example, material 24 may be characterized as a remnant of a prior floor covering, such as mastic, adhesive, paint, hardened glue and/or grout. The floor stripper machine is used to remove such material 24 prior applying a new floor covering. In some cases, the surface is simply smoothed and material 24 is removed without applying a new floor covering.

In the past, floor stripper machines have been used with abrasives or affixed cutters on a bottom surface of a plate 31. However, these machines are often difficult to control and may become dangerous. For example, in prior art designs, when a blade interacts with material 24 to be removed having a different density or different level, the entire floor stripper machine may vibrate, tilt and tend to run away from the operator 16 at an irregular and unpredictable orientation.

Generally, the present device improves the angle that the blade assemblies interact with the surface, the angle of blade orientation relative to the radial movement of the plate 31 and a suspension in each blade to address and dampen forces when the blades interact with a changing material 24 on the surface 47 of the floor 22. Additionally, the present design allows for easy replacement of any individual blade assembly for repair or changing due to the nature of the surface 47 contacting blade 20 used by the device.

Looking now at FIG. 1, an operator 18 holds the handle 14 of a floor stripper machine 12. The floor stripper machine 12 has a motor 28 powered by an electrical cord 30. The motor 28 rotates the plate 31. The blade assembly 16 is connected to a bottom surface of the plate 31. The blades 20 of the blade assembly 16 are in contact with the surface 47 of the floor 22. The blade assemblies 16 are then rotated to scrape along the surface 47 to remove unwanted material 24.

A wheel 26 may be provided on the floor stripper machine 22 upon which the machine rests for blade assembly 16 adjustment, maintenance and replacement. The wheel 26 also rotates to maneuver the floor stripper machine 12 with the blades 20 out of contact of the surface 47. A material 24 is integral to or adhered onto the surface 47.

Figure 2:
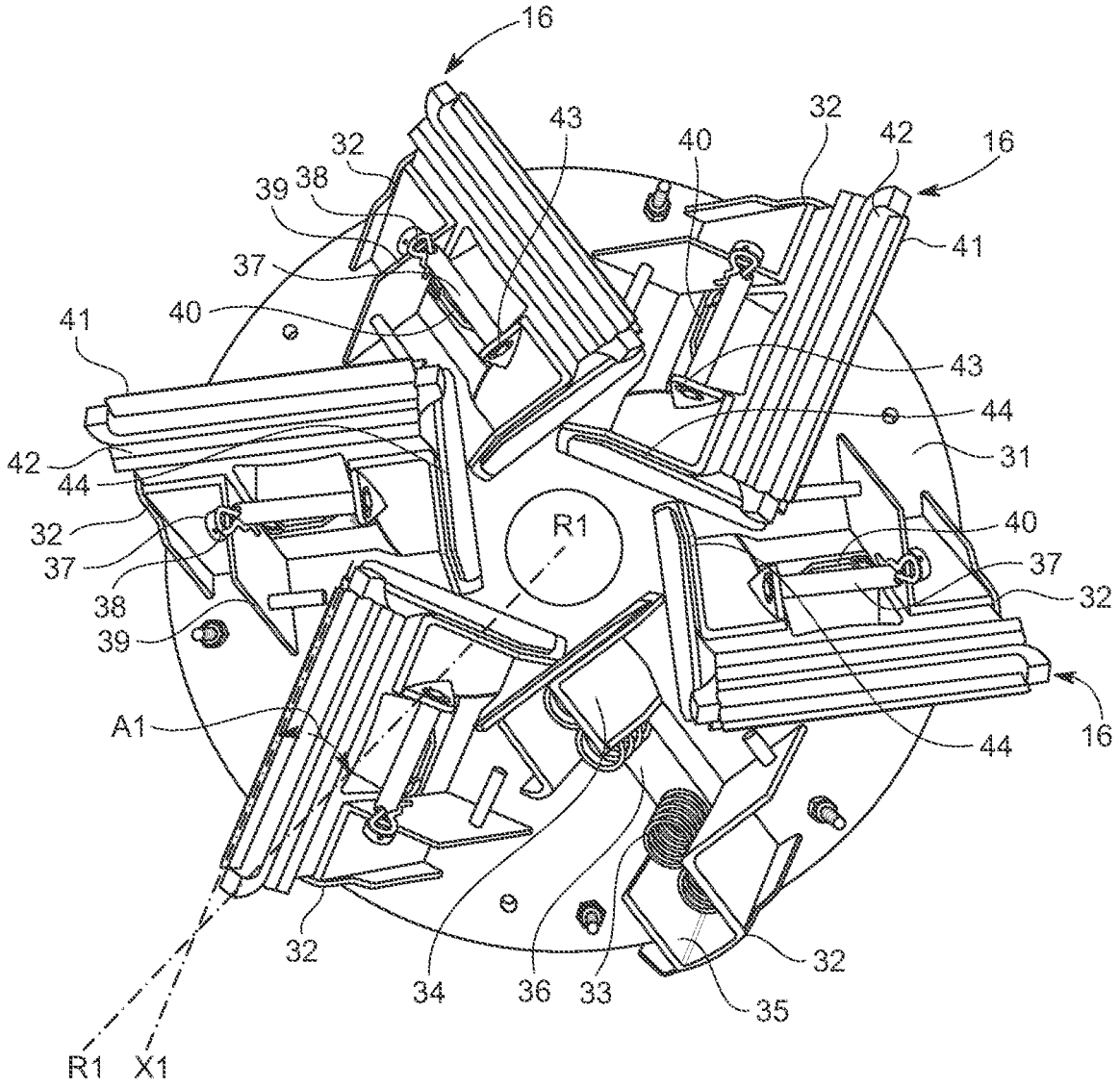
FIG. 2 shows a bottom perspective view of a blade assembly.

FIG. 2 shows the bottom surface of the blade assembly 16 with several blade assemblies at 16 affixed to the plate 31. In this figure, the blade assembly 16 at the lower right side is removed from the bracket assembly 32 to expose the suspension 33. In normal use, each of the bracket assemblies 32 would have a blade assembly 16 affixed along with the suspension 33.

Figure 3:
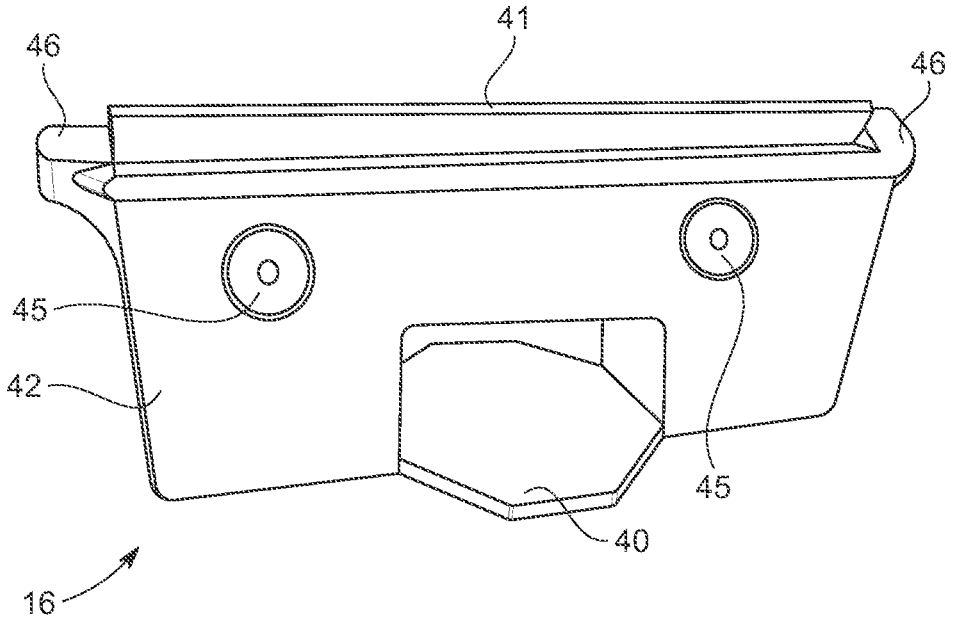
FIG. 3 shows a perspective view of a frame and blade assembly.

FIG. 3 shows a detail of a blade assembly 16. The blade assembly 16 is comprised of a frame 42 into which the blade 41 is inserted. Fasteners 45 secure the blade 41 into the frame 42. Generally, fasteners 45 may be removable, such as bolts or screws that can be removed to separate the blade 41 from the frame 42 for maintenance. Generally, the frame 42 will outlast the life of the blade 41. Therefore, the blades 41 are replaceable for extending the life of the blade assembly 16.

Blades 41 are generally planar bars of metal that are capable of maintaining a cutting edge for the particular material 24 and surface 47 expected to be present on a job site. For example, carbide, hardened tool steel or other alloys may be used for blade 41 material.

The blade assembly 16 is nested inside the bracket assembly 32 during normal operation of the floor preparation tool. Each bracket assembly 32 has a guide slot 34 and a guide slot 35 affixed to a base 36. The spacing between the guide slot 34 and guide slot 35 is complementary to the width of the blade assembly 16. A support 44 may also be present on one or both of guide slot 34 in guide slot 35 to strengthen the connection between the respective guide slot 34 and guide slot 35 and the base 36 and plate 31.

The blade assembly 16 is easily separable from the floor preparation tool by removing the key 38 and associated pin 37 from the bracket assembly 32. The pin 37 penetrates an aperture through the flange 39 and is secured into the flange with the key 38.

As a blade assembly 16 is slid into the bracket assembly 32 between the guide slot 34 and guide slot 35, the pin 37 is removed from the flange 39. The tab 40 of the blade assembly 16 is pressed into the bracket assembly 32 to compress the suspension 33 springs. The pin 37 is reinserted over the tab 40 to prevent the blade assembly 16 from separating from the bracket assembly 32 during normal use.

The suspension 33 presses against the bottom of the frame 42 and biases the tab 40 against the pin 37 to hold the blade assembly 16 firmly inside the bracket assembly 32. The flange 46 on the blade assembly 16 prevents the blade assembly 16 from over compressing the springs of the suspension 33.

When no or little pressure is applied against the blade 41 (eg. when the machine is not in motion or is turned over for maintenance) the suspension 33 forces the tab 40 to contact the pin 37 allowing the blade assembly 16 to be at its most extended position. During operation, as pressure is increased onto the blade 41, the springs of the suspension 33 tend to compress to the point where the flanges 46 contact the upper edge of the guide slot 34 and guide slot 35 to prevent further compression of the blade assembly 16 into the bracket assembly 32.

The suspension 33 is important for the stability of the floor preparation tool during operation. As the plate 31 and blades 41 rotate in a circular motion upon the floor 22, the entire floor stripper machine 12 has a tendency to rock and skitter as individual blades 41 meet different resistance. This tends to increase as a leading blade 41 encounters a material 24 on the surface 47 with a different texture, density or thickness, causing risk to the floor 22 and the operator 18.

Figure 4:
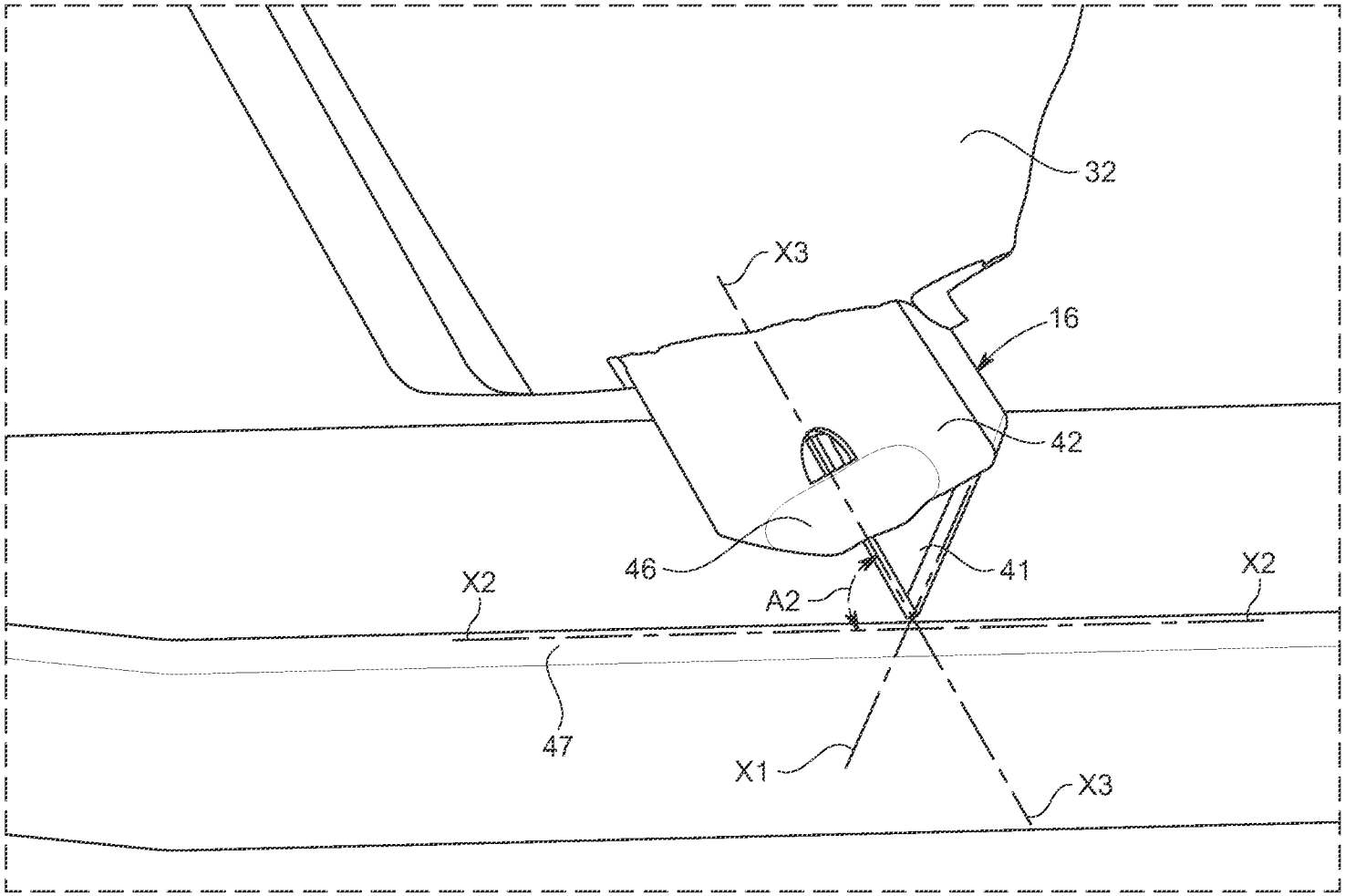
FIG. 4 shows a perspective detail of the blade interacting with a surface.

As the leading blade has different forces and pressures than a trailing blade, the machine has a tendency to lose stability. By providing a spring suspension 33 that allows the blade assembly 16 to extend and retract only along the line of axis X3, as seen in FIG. 4, a change in force caused by the blade 41 striking a different material 24 can be largely absorbed by the suspension 33. This greatly improves the stability of the machine during operation.

The guide slots 34 and 35 retain the blade assembly 16 so that the blade assembly 16 may only move with the suspension 33 about axis X3. By retaining the motion of suspension 33 travel on only along axis X3, the orientation of the blade 41 remains precisely on axis X1 relative to the rotational radius R1 of the plate 31. Simultaneously, the blade's 41 attack angle A2 between blade axis X3 and the surface 47 axis X2, the geometry of the blade 41 relative to the surface 47 is consistently maintained throughout the range of suspension 33 travel.

Looking again at FIG. 2, radius R1 line and axis X1 are identified. Radius R1 is the radius line from the center of the plate 30 about which the entire floor preparation tool rotates when in service. Axis X1 is coincidental to the tool edge of the blade 41. Angle A1 is the angle between radius R1 and axis X1.

By orienting the tool edge of the blade 41 askew to the rotational radius R1, the blade achieves a shearing effect. This shearing effect tends to cause the edge of the blade 41 to slice against the material 24 on the surface 47. This is opposed to other floor preparation tools in the prior art that tended to grind and scrape. The slicing and shear action of the skewed blade 41 is more effective. By nature of the blade 41 moving over the surface there is also a grinding and scraping effect occurring as well as a shear. The ratio of shear to grind/scraping is dependent on, among other characteristics, the angle of the cutting tool to the surface, type of cutting tool, material being removed, nature of the floor, cutting tool material and cutting tool shape.

FIG. 4 shows a detail of how the planer axis X3 of the blade interacts with the axis X2 of the surface 47. The angle A2 is defined as the angle between the planer surface of the blade 41 axis X3 relative to the planer aspect of the surface 47 shown as axis X2. By providing a smaller angle A2 between axis X2 and axis X3, the blade 41 will tend to cut more horizontally against the material 24 being removed from the surface 47. By maintaining the angle A2, the blade 41 will self sharpen when rubbing on the surface 47.

At lower angles A2, the blade 41 may be able to better get between the material 24 and the surface 47 to essentially peel off the material 24 from the surface 47. A greater angle A2 may provide a smoother cut and may be preferred for finishing operations as opposed to initial aggressive material 24 removal.

Figure 5:
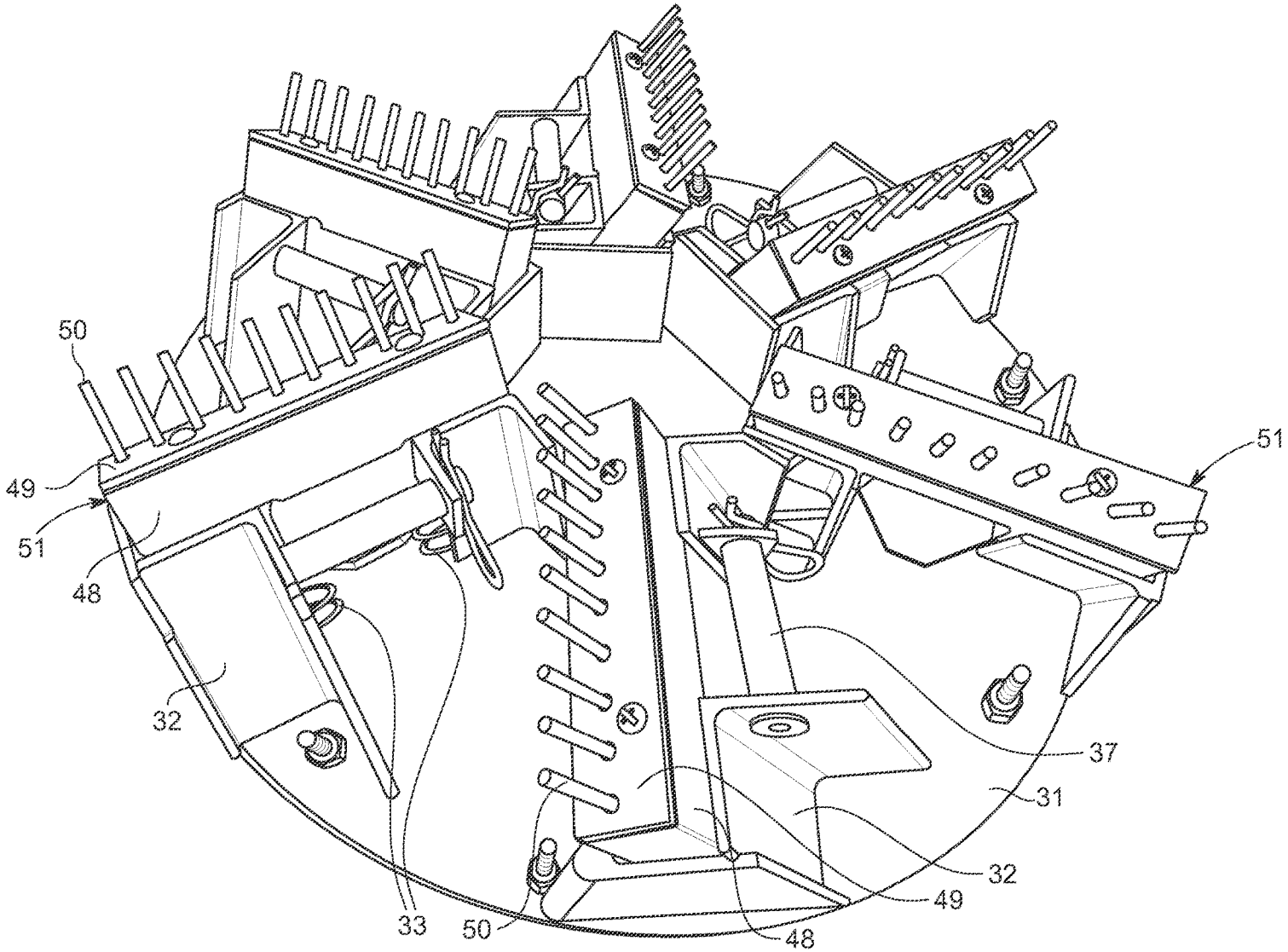
FIG. 5 shows a perspective view of a blade assembly.

FIG. 5, among other aspects, shows an alternative format of a blade assembly 51. Comparable to the other blade assembly 16, a blade assembly 51 includes a frame 48 that holds a cutting tool 49. The cutting tool 49 is further comprised of a plurality of a rigid tines 50. The tines 50 interact with the material 24 on the surface 47 similar to those of the blade 41. The tines 50 tend to be more aggressive in removing material 24.

Generally, and depending on the nature of the floor 22 and material 24, the tines in blade assembly 51 may be used to remove more difficult, coarse and hard materials. The blade assembly 51 may be a first step to prepare the floor. Then, a second pass of the floor preparation tool with the blades 41 may be used to finally finish the floor preparation and provide a smoother surface 47 of the floor 22.

The blade assembly 51 may be configured to have the tines 50 lined up on an axis askew from the rotational radius of the plate 31, similar to other versions of the device described above. Also similar, the angle of incidence between the long axis of each individual tines 50 against the axis X2 of the surface 47 may be adapted depending on the aggressiveness of ablation required, the hardness of the material 24, the adherence of the material 24 and the desired smoothness of the resulting surface.

The suspension 33 may be any means that tends to bias the blade assembly 16 or blade assembly 51 away from the plate 31. The strength of the suspension 33 is preferably selected so that when the weight of the machine rests on the tips of the blade 41 or tines 50, that the suspension 33 is not yet compressed or minimally compressed. This preserves some travel of the suspension 33 to absorb impact when the tines 50 or blade 41 strike an irregularity in the surface 47. The suspension 33 should not be so rigid that it is unable to absorb impact against the blade 41 or tines 50 or make it exceedingly difficult to manually remove the blade assembly 16 or 51 from the respective bracket assembly 32, because slight compression of the suspension may be required to remove the pin 37 when removing the blade assembly 16.

Although the suspension 33 in the drawings is shown as coil springs, other suspension means may be equally viable. For example, there may be lever springs, pneumatic pillows or other configurations that can bias the blade assembly 16 or 51 in an extended position and allow the appropriate absorption of impact when the tool is moved over difficult surfaces.

As shown in FIGS. 2 and 5, the plurality of blade assemblies 16 and 51 are spaced evenly about the plate 31. This provides a degree of balance for the tool, avoiding excessive pressure on any side of the plate 31 that may cause the device to irregularly dig into the surface 47. Although the blade assemblies are not along the radial lines of the rotation of the plate 31, they essentially occupy equally spaced segments of the plate 31. The center point of the plate 31 is generally the center of the plate and is the origin for radial measurements such as radius R1. The plate 31 is most commonly a circular plane of rigid material, it may take the form of other rigid planer symmetrical configurations. For example, a square plate may be effective with four or eight cutting tools. It may be effective when used with an angle of incidence of the blade that is also skewed from a radial line of the center of the plate and also includes the suspension. Similarly, a triangle configuration could have three cutting tools. In at least one configuration the blade assemblies can be on radial lines of the plate, coincidental to R1.

The tines 50 may be constructed from carbide rods from approximately one eighth to one quarter inch in diameter. The plurality of rods 50 are positioned in a comb configuration. As the tines 50 ablate on the surface 47 during use they tend to wear to a sharpened point and may become more effective. Individual tines may be a replaceable from the tool 49. Alternatively, an entire tool 49 may be reattached to a blade assembly for repair or maintenance. It should be appreciated that the tines 50 could also have a square, oval, hexagonal or other cross section and remain effective. The tines 50 may also be significantly larger, an inch or more, and should be considered depending on the nature of the floor contaminants, the weight of the machine, the speed of tool rotation and the alloy from which the tines 50 are fabricated.

The tines 50 version of the tool 49 may be more effective when the axis of the tines are at higher angles of incidence against the surface 47 than the smooth razor blade 41. The tines 50 may be particularly effective at angles between forty and ninety degrees between the axis of the tines 50 and the surface 47. The tines 50 may also be oriented at between ten and fifty degrees depending on the nature of the floor surface and material being removed. The tines 50 are generally more aggressive at material 24 removal than the smooth razor blades 41. In use, the tines 50 version of the device may be used first for aggressive removal and then the blade 41 version of the device used to finish the surface to a smoother texture.

An important version of the device can be fairly described as a floor preparation tool for use with a floor stripper machine that rotates the tool onto a floor and surface by removing material adhered to that floor. It generally includes a plate that on an upper surface is operably affixed to the motor of the floor stripper machine to cause a rotation of the plate. Affixed to the lower side of the plate are a plurality of bracket assemblies. Each bracket assembly is spaced equally around a center point of the plate in equal segments. For example, as shown in the drawings, the six bracket assemblies are equally spaced in segments about the center point of the plate. As noted above, there could be more or fewer bracket assemblies. Each bracket assembly is comprised of a base element positioned between a first guide slot and a second guide slot. Integrated to the base or frame of the bracket assembly is a suspension. Each bracket assembly is paired with a blade assembly. Each blade assembly is comprised of a frame affixed to a blade. The blade may either be a knife edge or a plurality of tines. Each blade assembly is dimensioned to fit between the first guide slot in the second guide slot of the respective bracket assembly so that the edge of the blade is held at a predetermined angle relative to the rotational radius of the plate. In other words, the imaginary radius line through the centerpoint is at a different angle than the cutting edge of the blade. Generally, it has been shown most effective to have the angle between the radius of the plate and the cutting edge of the blade to be between about ten and ninety degrees. Further, each bracket assembly holds the associated blade at an angle of between ten and eighty-five degrees between the plane or axis of the blade and the plane of the surface being prepared. Each frame is positioned inside of the respective bracket assembly between the first guide slot and second guide slot so that the bracket assembly, and associated blade, traverse inside the bracket assembly. A suspension, such as a spring, is located between the blade assembly and the bracket assembly to push an impact experienced on the blade during use of the tool. Generally, the suspension biases the cutting edge of the blade away from the plate 31. Optionally, the blade is characterized as a plurality of tines in a row, as opposed to a knife edge. Optionally, the blade or tines are in a tool or frame that is removable from the bracket assembly so that individual blades, tines or tools may be removed from the assembly for maintenance or replacement. Optionally, each blade assembly is removable without tools from the bracket assembly by use of a pin and key that allow for rapid removal and replacement of the cutting tools.

In a version of the invention the angle of the blades are adjustable in the field by the user. The blade assemblies and/or the bracket assemblies can be loosened and repositioned and then tightened in a preselected angle prior to use. This can affect the angle of incidence of the blade edge or tines as well as the skew relative to the radius. In other versions, the bracket assembly is permanently affixed (eg. bolted, welded . . . ) setting preselected angles when the device is manufactured.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. A floor preparation tool for use with a floor stripper machine to prepare a surface comprising:

a plate (31) on an upper side operably affixed to a motor (28) of the floor stripper machine (12);

affixed to a lower side of the plate (31) are a plurality of bracket assemblies (32);

each bracket assembly (32) is spaced equally around a center-point of the plate (31);

each bracket assembly (32) is comprised of a base (36) affixed to the lower side of the plate (31) and disposed between a first guide slot (34) and a second guide slot (35);

affixed to the base (36) is a suspension (33);

each bracket assembly (32) is paired with a single blade assembly (16);

each blade assembly (16) is comprised of a frame (42) affixed to a blade (41);

each blade assembly (16) is dimensioned to fit between the first guide slot (34) and second guide slot (35) of the respective bracket assembly (32) and holds an edge of the blade (41) at a preselected first angle (A1) measured from a point where a blade axis (X1) intersects the rotational radius (R1) on a perimeter of the plate (31);

the first angle (A1) is preselected between ten and ninety degrees;

each bracket assembly (32) holds the respective blade (41) at a second angle (A2) between an axis (X2) of the surface and the planar axis (X3) of the blade;

the second angle (A2) is preselected between ten and eighty-five degrees;

each frame (42) is positioned in the respective bracket assembly (32) between the first guide slot (34) and second guide slot (35) and the suspension (33) biases the frame away from the plate (31) along the planar axis (X3) of the blade and the suspension (33) compresses to retract the frame (42) within the bracket assembly (32) toward the plate (31) when the blade (41) strikes a material.

2. The floor preparation tool of claim 1 further characterized in that each blade (41) is comprised of a plurality of tines (50).

3. The floor preparation tool of claim 1 further characterized in that the blade (41) is separable and replaceable from the respective frame (42).

4. The floor preparation tool of claim 1 further characterized in that each blade assembly (16) is removably affixed to the bracket assembly (32) with a pin (37).

* * * * *